United States Patent [19]

Collin et al.

[11] 3,989,576

[45] Nov. 2, 1976

[54] APPARATUS FOR CONNECTING A FIRST WEB OF A WEB FORM MATERIAL, WHICH WEB UNWINDS FROM A FIRST ROLL, TO THE LEAD END OF A SECOND WEB OF A WEB-FORM MATERIAL, WHICH WEB UNWINDS FROM A SECOND ROLL

[75] Inventors: Heinrich Collin, Munich; Hans Mosburger, Weiherhammer; Gunther Lau, Katzwang; Hermann Josef Brandl, Nurnberg, all of Germany

[73] Assignee: Bayerische Bert- Hutten- und Salzwerke AG, Munich, Germany

[22] Filed: June 17, 1974

[21] Appl. No.: 480,167

[30] Foreign Application Priority Data

June 18, 1973 Germany .....2330945

[52] U.S. Cl. ..... 156/361; 156/494; 156/504; 156/505; 242/58.1; 242/58.5

[51] Int. Cl.[2] ..... B65H 19/08

[58] Field of Search ..... 156/361, 494, 502, 504, 156/505; 226/104; 242/58.1, 58.2, 58.3, 58.4, 58.5

[56] References Cited

UNITED STATES PATENTS

| | | | |
|---|---|---|---|
| 2,991,827 | 7/1961 | Hendrich et al. | 156/504 |
| 3,114,341 | 12/1963 | Diener | 156/504 |
| 3,645,463 | 2/1972 | Helm | 226/104 |
| 3,837,954 | 9/1974 | Nudinger et al. | 156/505 |

*Primary Examiner*—William A. Powell
*Assistant Examiner*—Jerome W. Massie
*Attorney, Agent, or Firm*—Woodhams, Blanchard and Flynn

[57] ABSTRACT

An apparatus for fixing the leading edge of a second rolled web to a point at or near the trailing edge of a first rolled web. The present invention is an improvement over the disclosure of U.S. Pat. No. 3,837,954, issued Sept. 24, 1974, wherein the leading edge of a second roll was adhered to a transfer roll while the trailing end of the first web was contacted by a suitable base roll. In this improvement, a fluid operated carriage forms a resiliently braked loop following the base roll and permits the web at the base roll to slow as needed to pick up the second web while not diminishing the speed of exiting of the web from the transfer apparatus. The carriage is moved in one direction to compensate for this change in relative speeds. The carriage is then caused to move in the opposite direction to generate a smoothly increasing force resisting such yielding then progressively increasing the pull on the web and its speed of withdrawal from the second roll. Thus, adherence between the webs is completed by the time tension is placed onto the point of adherence for the acceleration of the second roll.

11 Claims, 4 Drawing Figures

APPARATUS FOR CONNECTING A FIRST WEB OF A WEB FORM MATERIAL, WHICH WEB UNWINDS FROM A FIRST ROLL, TO THE LEAD END OF A SECOND WEB OF A WEB-FORM MATERIAL, WHICH WEB UNWINDS FROM A SECOND ROLL

FIELD OF THE INVENTION

The invention relates to a process for connecting a first web which unwinds from a first roll, to the lead end of a second web which unwinds from a second roll.

BACKGROUND OF THE INVENTION

In U.S. Pat. No. 3,837,954, a first web unwinding from a first roll is secured to the lead end of a second web on a second roll. The lead end of the second web is adhesively secured to the unwinding first web and the unwinding first web is then cut off behind the point of adherence. The lead end of the second web is first adhesively secured to a transfer element by means of an adherent surface provided on said second web and the transfer element is then moved toward the first web, and the transfer element is accelerated to a speed which corresponds to the speed of the unwinding first web. Next, the lead end of the second web is adhesively secured onto the first web by means of a further adherent surface which is provided at the lead end of the second web on the side thereof remote from the first adherent surface and is then released from the transfer element. The acceleration of the second roll, after adhering the lead end of the second web to the unwinding first web, occurs in response to the pull exerted by the first web. Pull load peaks and sudden loads occurring during the initial acceleration are avoided in the webs and the point of adherence between the webs by conducting the appropriate web through a power-storing device which is yieldable during an increased pull load.

The apparatus herein concerned is an improvement over the apparatus disclosed in the aforementioned U.S. Pat. No. 3,837,954, wherein the second roll, after the lead end of the second web has been adhered to the unwinding first web, is accelerated smoothly and without jerking.

SUMMARY OF THE INVENTION

This puspose is attained according to the invention by accelerating the transfer element simultaneously with the tightening of a loose starting zone of the second web.

By tightening the loose starting zone the adhering of the second web to the first web and the acceleration of the second roll do not coincide in time. Thus, the second roll is accelerated only when the adhering operation is finished. In this manner, tearing at the adherence point becomes minimal.

With respect to the starting operation, it is advantageous if a power-storing device is provided with profiled bar having a substantially linear characteristic, which, however, in the beginning zone and/or end zone increases or decreases and which is hereinafter referred to as a characteristic curved path.

The power-storing device permits a smooth starting of the second roll. It prevents peak loads from tearing the web and therefore makes it possible that less tear-resistant material can be used.

A device for carrying out the process according to the invention is advantageously constructed by providing the powerstoring device with a carriage having a guide roller thereon for the material web, which, at a suitably measured increased pull load in the web material, can be moved by driving means for the purpose of shortening the web, which driving means is controlled by a control mechanism with a substantially linear characteristic curved path, which, however, in the beginning zone adjacent an initial position of the carriage and/or an end zone, is inclined upwardly or downwardly, and after reduction of the increased pull load can be returned into the initial position.

The inventive power-storing device is constructed simply and is safe in operation. The carriage is constructed for easy movement whereby it can react quickly to an increased pull load in the web material. The driving means is so controlled by the control mechanism that the carriage, upon occurrence of a pull load in the web material, moves in a direction to shorten a loop of the web material which is placed around the roll of the carriage.

In this manner the speed of the adherence point of the old and the new web is first reduced and then, during braking of the carriage or during returning of the carriage, accelerated to the normal speed.

In consideration of operating safety, it is desirable to construct the driving means as a hydraulic motor which is connected to a driven oil pump.

A simple and operatively safe control can be achieved when the control mechanism has a throttle valve which blocks the oil feed to the hydraulic motor in accordance with a characteristic curved path.

It is advantageous for simplicity if the throttle valve is mounted on the carriage and has a roller lever which operates a shut-off valve and which is guided by a guide bar arranged parallel to the path of movement of the carriage.

BRIEF DESCRIPTION OF THE DRAWINGS

Exemplary embodiments of the invention are illustrated hereinafter in connection with the drawings, in which.

DETAILED DESCRIPTION

Figure 1:
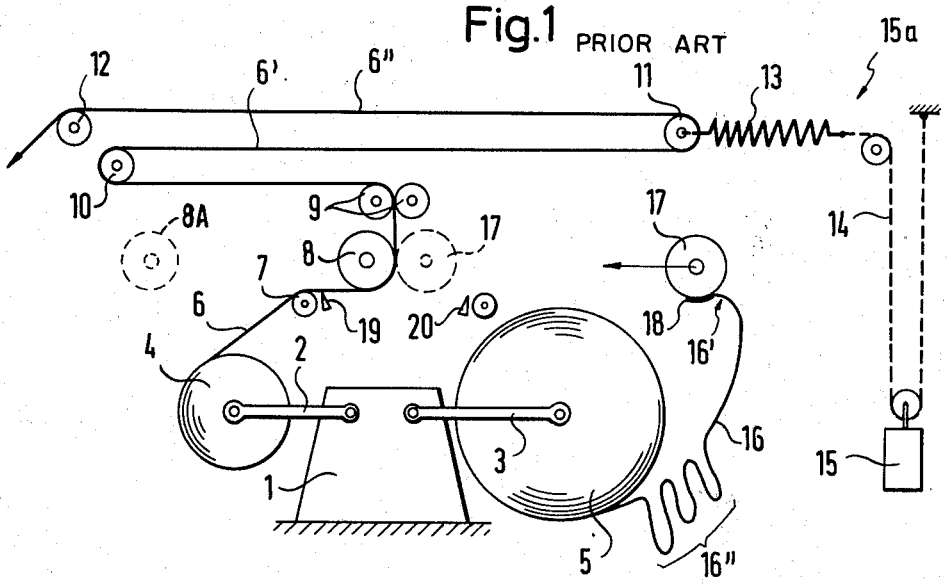
Fig.1 PRIOR ART
FIG. 1 is a schematic illustration of a device for carrying out the inventive process corresponding to a first exemplary embodiment.

FIG. 1 illustrates a first exemplary embodiment of a device for carrying out the inventive process. Two support arms 2 and 3 which can be pivoted and locked in position independent from one another are mounted on a frame 1. Each of said support arms 2 and 3 carries on its outer end a support axis for mounting a roller 4 or 5 of web material wound thereon. In the illustrated exemplary embodiment they are rolls of paper. A first web 6 is unwound from the roll 4. The web runs over a guide roller 7 to a drum 8 and from there between a pair of guide rollers 9 to a further stationarily supported guide roller 10. The run 6' of the web 6 is then conducted to a guide roller 11, is there reversed 180° and proceeds to the next guide roller 12 as run 6'' and then to a further processing mechanism which is not illustrated in the drawing. The guide roller 11 is supported on a carraige which is not illustrated for reasons of simplicity. Said carriage is guided movably on guide rails, also not illustrated, for movement in a direction parallel to the direction of the runs 6' and 6'' of the web 6. The end of a tension spring 13 is secured to the guide roller 11 or to the carriage which supports the guide roller. The other end of the spring is connected to a traction wire 14. The traction wire 14 is looped downwardly and is secured at its other end to an anchor. A weight 15 is hung in the loop of the traction wire 14. The movable guide roller 11, the spring 13, the traction wire 14 and the weight 15 form together with the runs 6' and 6'' of the first web 6 a power-storing device 15*a*, which upon occurrence of sudden loads and tractive force peaks prevents tearing of the web. It has a characteristic curve which is flat in the beginning zone, then rises progressively and passes over into a linear zone. When the tension in the web 6 increases, the pull exerted on the guide roller 11 by the runs 6' and 6'' of the web increases thereby causing the spring 13 to be elongated and the guide roller 11 to move in such a direction with respect to the guide rollers 10 and 12 as to shorten the loop which is formed by the runs 6' and 6'' of the web 6. Thus, this provides a storage element. Intermittent loads on the web 6 are eliminated from the start due to the resiliency of the spring 13. This storage device is particularly advantageous during connection of a second web 16 which is unwound from the roll 5 to the first web 6.

When most of the first web 6 has been removed from the roll 4 and roll 4 is nearing an end, the lead end 16' of a second web 16 which unwinds from roll 5 must be connected to the first web 6 in order to ensure continuous operation. In the device of FIG. 1, a transfer element designed as a roller 17 is provided for this purpose and can be moved to and from the drum 8. For this purpose the roller 17 is supported rotatably on a carriage which is not illustrated. The carriage can be driven by a motor which engages through pinions toothed racks which are not illustrated and extend along the guides of the carriage. The transfer roller 17 is shown in FIG. 1 in solid lines in its receiving position in which it is spaced from the roller 8. In this position, the lead end 16' of the second web 16 is adhered to the circumferential surface of the roller 17, here by means of an adhesive strip 18 provided with adhesive on both sides. The web 16 has between the roll 5 and the roller 17 a looped, loose starting zone 16''. The adhesive strip 18 must be cemented to the beginning of the second web with the cemented extent such that an appropriate relationship is established between the part which is cemented to the beginning of the web and the part which is cemented to the circumference of the roller 17 to ensure that when the full extent of the adhesive strip 18 is pressed with its side remote from the web 16 against the web 6 the adhesive strip 18 will separate from the surface of the roller 17 but will adhere to the lead end 16' of the web 16.

When the lead end 16' of the second web 16 is cemented to the roller 17 and a connection of the lead end 16' with the first web 6 is to occur, the roller 17 is moved in direction of the web 6. When the roller 17 has reached the position which is illustrated by dashed lines in FIG. 1, namely has been guided into its connecting position, it contacts the first web 6. The roller 8 serves as a backing which permits the roller 17 to be urged against the web 6 under pressure. The roller 17 is rotated after it has contacted the web 6 and is accelerated to a circumferential speed corresponding to the speed of the web 6. This acceleration does not cause any sudden loads on the second web 16, because in it is provided the looped, loose zone 16'' which has been removed earlier from the roll 5 and which is taken up during such acceleration. During rotation of the roller 17, the adhesive strip 18 contacts the web 6 and is pressed against said web. During further movement of the web 6, the adhesive strip 18 is removed from the roller 17 due to the relationship between the entire outer adhesive strip surface cemented to the first web and the inner adhesive strip surface adhering to the surface of the roller 17. The lead end 16' of the second web 16 is then fixed to the first web 6 by the adhesive strip 18 and is drawn along by the first web. This operation takes place very rapidly. The roller 17 is at this time pressed onto the roller 8 by the action of the positive drive. As soon as enough time has passed for the new web 16 to attach to the old web 6, the positive drive of the roller 17 is switched off, by means of a pressure-sensitive switch and an adjustable time relay. Furthermore a cutting device which is arranged in front of the roller 8 and which has a reciprocal cutting blade 19 is then activated and the cutting blade 19 cuts the first web 6. The second web 16, which is connected with the part of the web 6 which is drawn upwardly, is then drawn from the roll 5. The roller 8 as set forth in more detail the U.S. Pat. No. 3,837,954, can now be returned to its initial position as indicated by the broken line 8*a*.

The new roll 5 must be accelerated at the exact moment the second web 16 is picked up by the first web 6. In the device illustrated in FIG. 1, this is accomplished entirely by the tension developed in the web 16. This produces an increased pull load in the web 6 and the web 16 connected thereto until the roll 5 has been accelerated to its operational speed. However, a sudden load causing the web to tear cannot be produced because the guide roller 11 is moved in this phase under the effect of the tensions of the runs 6' and 6'' toward the guide rollers 10 and 12, thereby causing the spring 13 to be stretched. The loose starting zone 16'' prevents the cementing and the accelerating of the web 6 from occurring simultaneously, namely the web 16 is first cemented to the web 6 and, after the loose starting zone 16'' becomes tensioned, the roll 5 is accelerated. The characteristic curve of the powerstoring device 15*a* permits a smooth acceleration of the roll 5 and permits the use of less tear-resistant web material. As soon as the roll 5 is accelerated to the required operating speed and with the web 16 consequently unwinding at the desired speed from the roll 5, the guide roller 11 can be moved with its carriage again in the direction away from the guide rollers 10 and 12, namely to the right as seen in FIG. 1, in order to relax the spring 13 and to enlarge the storage means formed by the runs 6' and 6''.

The device of FIG. 1 is constructed in such a manner that not only the web 16 can be cemented to the web 6 during continuous operation, but also in reverse a new web 6 can be connected to a previously unwinding web 16. As described in U.S. Pat. No. 3,837,954, the roll 8 here moves toward roll 17 and the steps are reversed.

Figure 2:
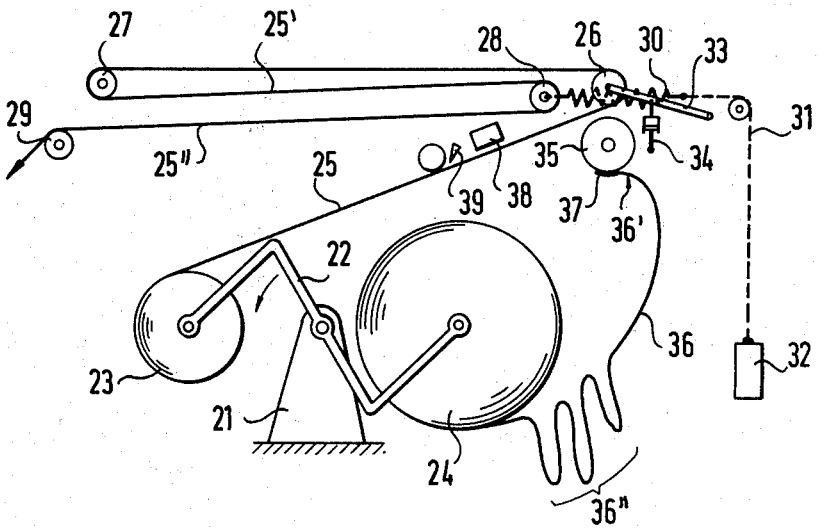
Fig.2 PRIOR ART
FIG. 2 is a schematic illustration of a device for carrying out the inventive process according to a second exemplary embodiment.

FIG. 2 schematically illustrates a second exemplary embodiment of a device for carrying out the inventive process, in which also the connecting of the new web to the old web and the roll change can take place without a reduction in speed of the first unwinding web. The structure and the details of the second embodiment are described in detail in U.S. Pat. No. 3,837,954. The basic difference from the first embodiment lies in that the two rolls 23 and 24 are supported on one swingable common support. After unwinding of the first web, the second web 36 which for example is wound on the roll 24 is cemented to the first unwinding web 25 in the described manner and both rolls 24 and 23 are then exchanged in their position. The powerstoring device 15*a* which is formed by the spring 30, the traction wire 31 and the weight 32 has also, like the storage device 15*a* illustrated in FIG. 1, a characteristic curve which at the start is flat, then progressive and later linear. The second web 36 which is to be cemented also has a loose starting zone 26 which has the same purpose and operation as in the first exemplary embodiment.

Figure 3:
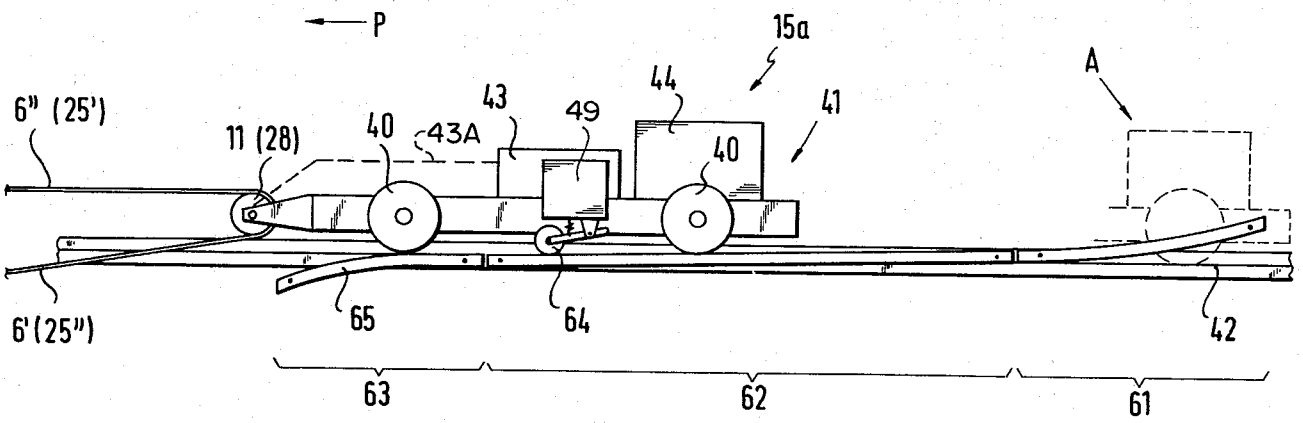
FIG. 3 is a detailed view of a power-storing device according to the invention.

FIG. 3 illustrates a hydraulically constructed powerstoring device 15*a*. As can clearly be seen, same has a carriage 41 which runs on four wheels 40, which carriage carries at the one of the two front ends the already known guide rollers 11 or 28. The carriage runs with its wheels 40 on guide rails 42 which are substantially arranged in a horizontal plane. The carriage is moved by a driving means 44 which is controlled by a control mechanism 43. The driving means 44 is here a hydraulic motor which is connected to a driven oil pump 46 through a feed line 45 (FIG. 4).

Figure 4:
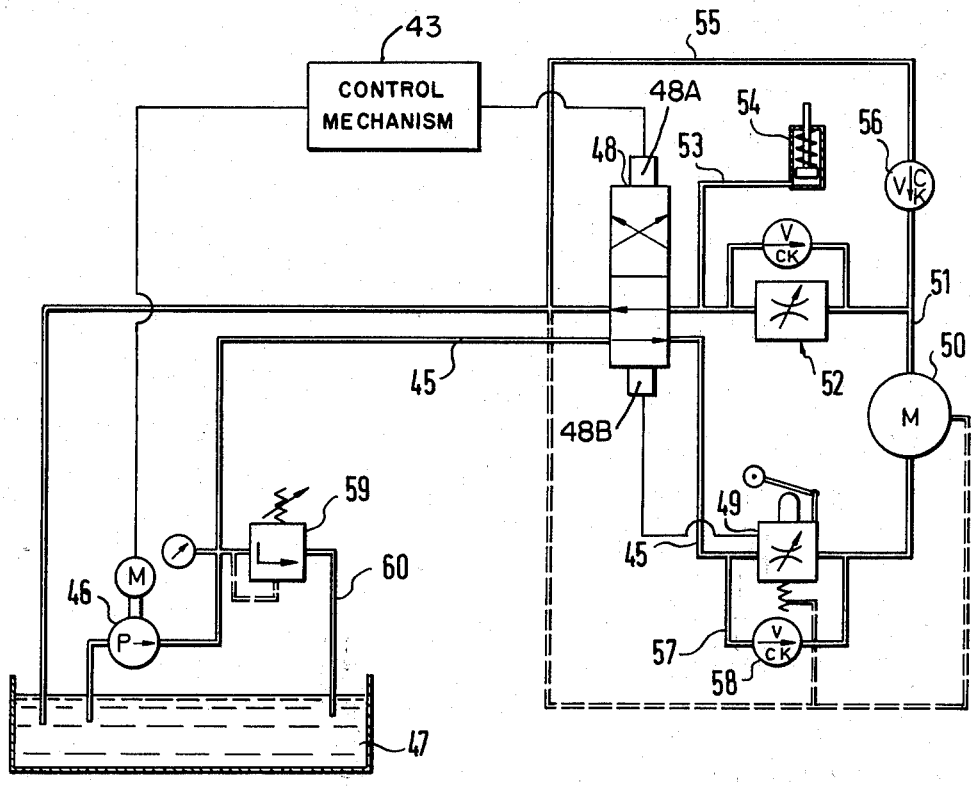
FIG. 4 is a schematic illustration of the power-storing device as illustrated in FIG. 3.

Further structure for the hydraulic means operating the carriage in the inventive power-storing device 15*a* is illustrated in FIG. 4. All illustrated hydraulic parts are in their initial at-rest positions. The driven oil pump 46 is connected on one side to a storage tank 47 and on the other side through the feed line 45 to a magnetically operated two position, two-way valve 48 and a roller-lever operated throttle valve 49 and to a hydraulic motor 50. A discharge line 51 leads from the hydraulic motor 50 through an adjustable throttle check valve 52 to the second connection of the already mentioned valve 48 and then returns to the oil tank 47. Between the throttle check valve 52 and the connection to the valve 48, a secondary line 53 is also connected to the discharge line 51, which secondary line 53 leads to an unlocking cylinder 54 for a lock pawl (not illustrated) for the carriage. The discharge line 51 in the portion thereof which includes the valve 48 and the throttle check valve 52 is bridged by a line 55 into which is inserted a check valve 56 which blocks the oil being discharged from the hydraulic motor. In the same manner, the throttle valve 49 is bridged by a line 57 into which is also inserted a check valve 58 which blocks the oil stream being discharged from the hydraulic motor. The feed line 45 has also a branch to a pressure-limiting or relief valve 59 which is connected to a return line 60.

If a measuring device (schematically illustrated by the broken line connection 43A to the control mechanism 43) measures an increased pull load in the web material, then the oil pump 46 is activated and a solenoid of the valve 48 is energized. This causes oil to be pumped from the tank 47 into the feed line 45. The valve 48 was shifted by the energization of the solenoid into the position where a part of the feed line 45 is connected to a part of the discharge line 51. This causes the pressure to rise in the secondary line 53 and the lock pawl 54 no longer holds the carriage 41 in its initial position. The oil goes both through the throttle part and also the check valve part of the throttle check valve 52 to the hydraulic motor 50 and energizes same. The carriage is thus moved in direction of the arrow P illustrated in FIG. 3. The loop formed by the runs 6' (25'') and 6'' (25') around the guide roller 11 (25') is shortened by the movement of the carriage 41. The oil which flows from the hydraulic motor passes through the line 45 to the roller-lever operated throttle valve 49. The lever 64 has a roller thereon which is guided, as is shown in FIG. 3, by a curved guide bar 65 which is generally S-shaped and is inclined upwardly in a starting zone 61, is linear or horizontal in the central zone 62 and is inclined downwardly in the end zone 63. As long as the carriage 41 is in the zone of its intial position A, which is illustrated on the far right in FIG. 3, the throttle valve 49 is fully open, namely the carriage 41 is fully accelerated. With an increasing distance from its initial position A, the throttle valve 49 throttles the oil passage and progressively decreases the rotating speed of the hydraulic motor or the traveling speed of the carriage 41.

The oil which is discharged from the throttle valve 49 passes through the line 45 and the valve 48 which is in the crossover position into the discharge line 51 and thus returns into the tank 47. As soon as the throttle valve 49 throttles a certain portion of the oil infeed, the pressure-limiting valve 59 is operated and allows any excess oil to flow back into the tank 47 through the return line 60. When the throttle valve 49 has restricted the oil passage sufficiently to stop the hydraulic motor 50 and therefore to stop the carriage 41, the valve 48 is shifted into the position illustrated in FIG. 4. Such can, if desired, be accomplished by effecting an energizing of a solenoid 48B in reference to the lever on the valve 49 reaching a predetermined position. The oil pump 46 can now convey the full stream through the line 45 and 57, and through the check valve 58 to the hydraulic motor 50. By reversing the flow direction, the hydraulic motor 50 drives the driving wheels 40 in the opposite direction and the carriage 41 is moved against the arrow P in FIG. 3. The oil returns from the hydraulic motor 50 through the throttle part of the adjustable throttle check valve 52 into the tank 47. The adjustment of the throttle check valve 52 has direct influence on the return speed of the carriage 41. As soon as the carriage has again reached its initial position, the oil pump stops. Upon subsequent reduction of the pressure in the hydraulic system, the lock pawl which holds the carriage 41 in its initial position again locks. The cycle can then repeat.

The invention is not limited to the illustrated exemplary embodiment. Thus it is for example conceivable to build the illustrated hydraulic power-storing device 15*a* without a control mechanism. It is sufficient during the movement of the transfer element to the first web to move the storage carriage 41 at a slow speed for immediate commencement of a discharge procedure. For this movement, the valve 48 must be in its crossed position in FIG. 4. This results first in that although the web is issuing at full speed from the apparatus, the speed is reduced at the adhesion point. Thereupon, as the paper loop 16'' or 36'' is used up and the new roll 5 or 24 is to be accelerated, the storage carriage 41 compensates for the difference between the exiting amount of paper and the entering amount of paper by increasing its speed. Additional oil thus follows through the check valve 56. At this stage the hydraulic motor operates as a pump. The throttling of the stream of oil in the roller-lever operated throttle valve 49 effects a controlled braking of the carriage and thus an acceleration of the new roll. While in the embodiments which have been described so far the return movement of the storage carriage into the initial position occurred actively by the hydraulic motor, it is easily conceivable to feed the fluid which is conveyed during the pumping operation of the hydraulic motor to a hydrostorage device and to utilize the stored amount of fluid for the return movement of the storage carriage.

It is furthermore conceivable not to permit the hydraulic equipment to travel on the storage carriage, but to arrange same stationarily and to use means such as a chain for movement of the storage carriage. The control cam for the roller-operated throttle valve can in this case be connected to a threaded nut carried by a screw which is driven simultaneously by the driving motor and be thereby caused to travel through a path of positioning movement which is a function of the carriage path.

In a further modification it is conceivable to construct the transfer element as a suction roller so that the start of a new web is held frictionally, positively and with the material effectively locked onto a connecting surface of the transfer element.

Furthermore it is conceivable to construct the storage device 15*a* pneumatically or electrically. A further variation can be seen in arranging the swivel guide bar which is composed of sections adjustable in height.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a device for connecting a first web of a web-shaped material unwinding from a first roll to the beginning of a second web of a web-shaped material unwinding from a second roll and having at least one transfer element and releasable engaging means for releasably coupling said second web to said transfer element, means for accelerating said transfer element to the speed of said first web and means for moving said transfer element to said first web to join said first and second webs, said transfer element engaging said first web and effecting a pressing of said beginning of said second web to said first web and adhesive means for connecting said first web to said beginning of said second web, the improvement comprising track means extending generally parallel with an exiting strand of said first web, carriage means movably mounted on said track means, said carriage means including a movable carriage, a guide roller rotatably mounted on said carriage for guiding said first web thereover and reversible drive means for alternately driving said carriage in both opposed directions along said track means, control means for controlling the speed of operation of said drive means and, consequently, the speed of movement of said carriage, said control means including measuring means for determining the existence of a pull load by said web on said carriage to effect a yielding by a carriage movement to an increased pull load on said web and a minimizing of pull load peaks and shock loads during initial acceleration of said second web, said control means further including an elongated bar having at least one surface of varying elevation and a substantially flat portion and valve means operatively connected to said elongated bar and responsive to said surface of said elongated bar to effect a control of said speed of operation of said drive means and, consequently, the speed of movement of said carriage at least in a direction of movement of said carriage away from an initial position thereof.

2. The improvement according to claim 1, wherein said reversible drive means includes a drive motor mounted on said carriage.

3. The improvement according to claim 1, wherein said drive motor is a hydraulic motor and is connected in fluid circuit with a hydraulic pump.

4. The improvement according to claim 3, wherein said valve means includes a controllable throttle valve;

wherein said elongated bar extends coextensively with said track means; and wherein said controllable throttle valve has lever means engaging said elongated bar, said throttle valve being connected in circuit with said drive motor to control the speed of movement of said drive motor in response to a change in the relative elevation of the surface of said elongated bar, the changing elevation of the surface of said elongated bar effecting a movement of said lever means as said carriage is driven along said track means.

5. The improvement according to claim 4, wherein said elongated bar has a substantially straight midportion extending parallel to said track means and a curved section at opposite ends thereof, said curved sections curving in opposite directions;

wherein said lever means has a roller thereon engaging said elongated bar; and wherein said throttle valve is a shut-off valve controlling the movement of said lever means.

6. The improvement according to claim 4 including a check valve in a line bridging said throttle valve, whereby during a return of said carriage to said initial position, the oil can be conducted past said throttle valve through said check valve.

7. The improvement according to claim 4, including a pressure-limiting valve at the outlet of said hydraulic pump.

8. The improvement according to claim 4 wherein said control means includes an adjustable throttle check valve, wherein the hydraulic discharge of said hydraulic motor is throttled by said throttle check valve during a return of the carriage to said initial position.

9. The improvement according to claim 4, wherein said drive motor is a hydraulic motor and is connected in fluid circuit with a hydraulic pump; and wherein said means determining the direction of movement of said carriage is a two position, two-way valve connected in fluid circuit with said drive motor.

10. The improvement according to claim 4 wherein said elongated bar has a substantially straight midportion extending parallel to said track and a curved section at opposite ends thereof, said curved sections curving in opposite directions.

11. The improvement according to claim 1, wherein said control means includes second valve means for controlling said drive motor and the speed of movement of said carriage in a direction toward said initial position.

* * * * *